US006006806A

United States Patent [19]

Marschke

[11] Patent Number: 6,006,806

[45] Date of Patent: Dec. 28, 1999

[54] LAMINATED CORRUGATING ROLL

[75] Inventor: Carl R. Marschke, Phillips, Wis.

[73] Assignee: Marquip, Inc., Phillips, Wis.

[21] Appl. No.: 09/013,347

[22] Filed: Jan. 26, 1998

[51] Int. Cl.[6] ..... B31F 1/26

[52] U.S. Cl. ..... 156/472; 29/895.213; 492/30; 492/40; 492/46; 165/89; 165/DIG. 156

[58] Field of Search ..... 428/544, 573, 428/577, 579, 585, 596, 601, 604; 156/472, 473; 29/895.213; 492/30, 40, 47, 36, 38, 46; 172/537; 72/180; 165/89, DIG. 156

[56] References Cited

U.S. PATENT DOCUMENTS

| | | | |
|---|---|---|---|
| 73,467 | 1/1868 | Seely | 492/36 |
| 1,016,817 | 2/1912 | Diffenderfer | 492/38 |
| 1,540,588 | 6/1925 | Alexander | 492/38 |
| 2,352,501 | 6/1944 | Slavicek | 492/36 |
| 3,830,088 | 8/1974 | Couper et al. | 72/196 |

FOREIGN PATENT DOCUMENTS

| | | |
|---|---|---|
| 210529 | 11/1955 | Australia . |
| 1066438 | 6/1954 | France . |
| 1462089 | 12/1966 | France . |
| 63-5898 | 1/1988 | Japan . |

*Primary Examiner*—Michael W. Ball
*Assistant Examiner*—Gladys Piazza
*Attorney, Agent, or Firm*—Andrus, Sceales, Starke & Sawall

[57] ABSTRACT

A heated cylindrical roll for handling and treating a running web of material has a laminated construction in which a series of thin circular rings, each in turn formed from a plurality of flat ring segments, are joined face-to-face to form a hollow cylindrical roll. The segments from which the circular rings are formed may comprise identical stampings and may be machined or otherwise formed prior to assembly to include an outer tooth pattern to provide a fluted roll surface for corrugating, apertures extending between the faces of the segments to define axial fluid supply passages in the assembled roll, radial slots to define vacuum passages in the assembled roll, and/or outer peripheral slots to define vacuum distribution slots in the surface of the assembled roll. The laminated roll is particularly adapted to utilize a novel steam supply and condensate return system.

15 Claims, 3 Drawing Sheets

11
13
14
15
16
17
18
20
21
27

11
12
14
15
16
17
20
21
22
23
25
27
37

LAMINATED CORRUGATING ROLL

BACKGROUND OF THE INVENTION

The present invention pertains to a laminated construction for a roll used in web handling and treating systems and, more specifically, to such a laminated roll particularly adapted for use as a corrugating roll in a single facer for the manufacture of corrugated paperboard.

Rotary cylindrical rolls are used in a wide variety of applications for treating web materials. In one particularly common use, webs of a material such as paper are wrapped around a heated rotary roll which transmits heat to the traveling paper web. In the manufacture of corrugated paperboard, the fluted corrugating rolls used to form the corrugated medium web are also typically heated. Because of the high speeds at which corrugating rolls operate, the heavy loads to which they are subjected, and the large thermal excursions to which the rolls are subjected during operation, corrugating rolls are typically of heavy construction. Such heavy construction results in high material and manufacturing costs. Furthermore, the typical heavy cylindrical wall construction of heated corrugating rolls also results in problems of uneven heat distribution and slow thermal response.

SUMMARY OF THE INVENTION

In accordance with the present invention, a cylindrical roll utilizes a laminated construction which is readily adaptable to operate with a circulating steam heating system, a fluted outer surface for corrugating, and a system for applying vacuum to the flutes of the fluted outer surface. A rotatable cylindrical roll of the present invention, adapted for curing and treating of material web such as paper, includes a series of flat ring segments each having opposite parallel faces, which segments are positioned end-to-end and joined to form a circular ring. Each ring segment is provided with a plurality of apertures which extend between the opposite faces. A plurality of circular rings are positioned face-to-face and joined to form the cylindrical roll. The apertures in the ring segments are aligned ring-to-ring to define a plurality of axially extending circumferentially spaced passages through the roll.

The ring segments and/or the circular rings may be joined by welds. The cylindrical roll includes opposite enclosing end walls which end walls are interconnected with tie rods to join and hold the circular rings. Preferably, fluid conducting tubes are inserted into the axially extending passages and intimately joined to the passage walls defined by the apertures. In a preferred embodiment, the tubes are joined to the passage walls by explosive bonding. The tubes may also be joined to the passage walls with soldered joints. The use of explosive bonding to join the tubes to the passage walls may also include a supplemental bonding agent in the joint interface, and such supplemental bonding agent may also comprise a solder.

In an alternate embodiment, the ring segments in adjacent circular rings are rotationally offset. In this alternate construction, fluid conducting tubes are also inserted in the passages and joined to the passage walls defined by the apertures.

In a preferred embodiment of the invention, the ring segments are provided with patterns of flutes formed in the radial outer edges thereof with the flutes being aligned in the cylindrical roll to define a fluted roll surface. The roll may also be provided with radially extending channels which are formed in the faces of selected ring segments. In the assembled roll, the channels define paths of communication with the outer roll surface.

DETAILED DESCRIPTION OF THE PREFERRED EMBODIMENTS

Figure 1:
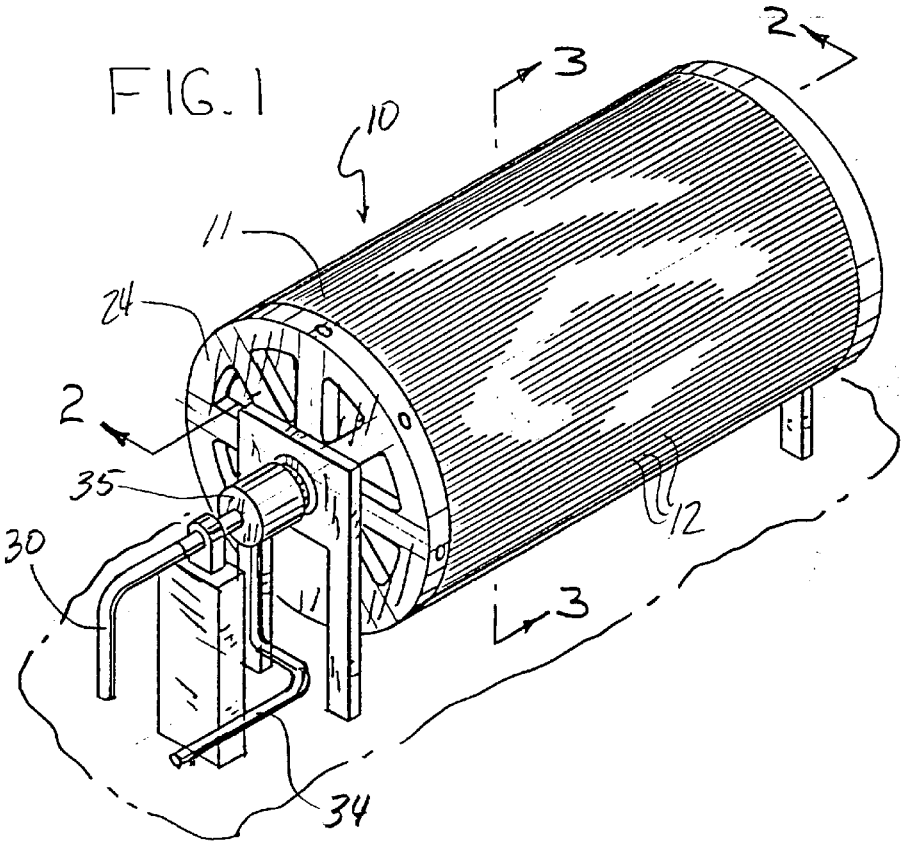
FIG. 1 is a perspective view of a heated roll utilizing the construction of the present invention.

The present invention is shown in FIG. 1 as applied to a steam heated corrugating roll 10 of the type used in the manufacture of a single face corrugated paperboard web. Thus, the outer periphery of the cylindrical outer wall 11 of the roll 10 is provided with a pattern of teeth or flutes 12 which, with a similar interengaging the counterrotating roll (not shown), forms a nip into which a paper web is fed and corrugated prior to being glued to a liner web to form the single face paperboard web, all in a manner well known in the art. It is also known in the art to heat the roll with steam to enhance the curing of the adhesive used to join the web components. In the embodiments shown herein, the corrugating roll 10 utilizes a steam supply and distribution and condensate return system of the type described in my co-pending application Ser. No. 08/932,332, filed on Sep. 17, 1997, and entitled "Steam Supply and Condensate Removal Apparatus for Heated Roll, now U.S. Pat. No. 5,899,264".

Figure 2:
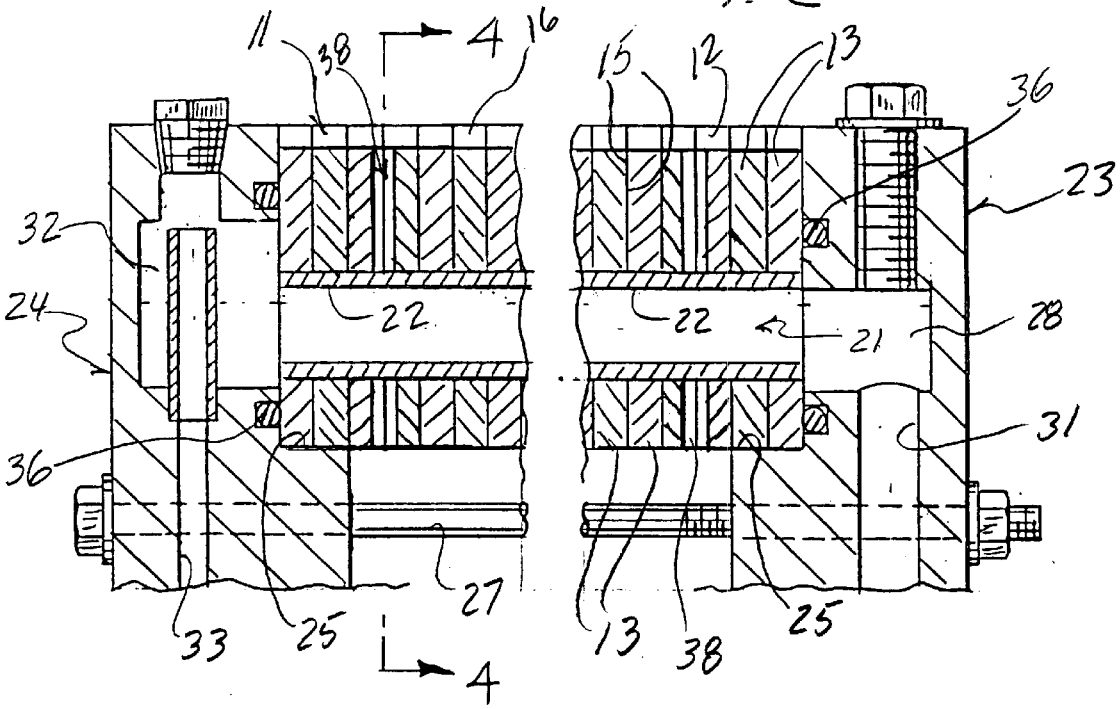
FIG. 2 is a partial vertical section through the upper portion of the roll taken on line 2—2 of FIG. 1.
Figure 3:
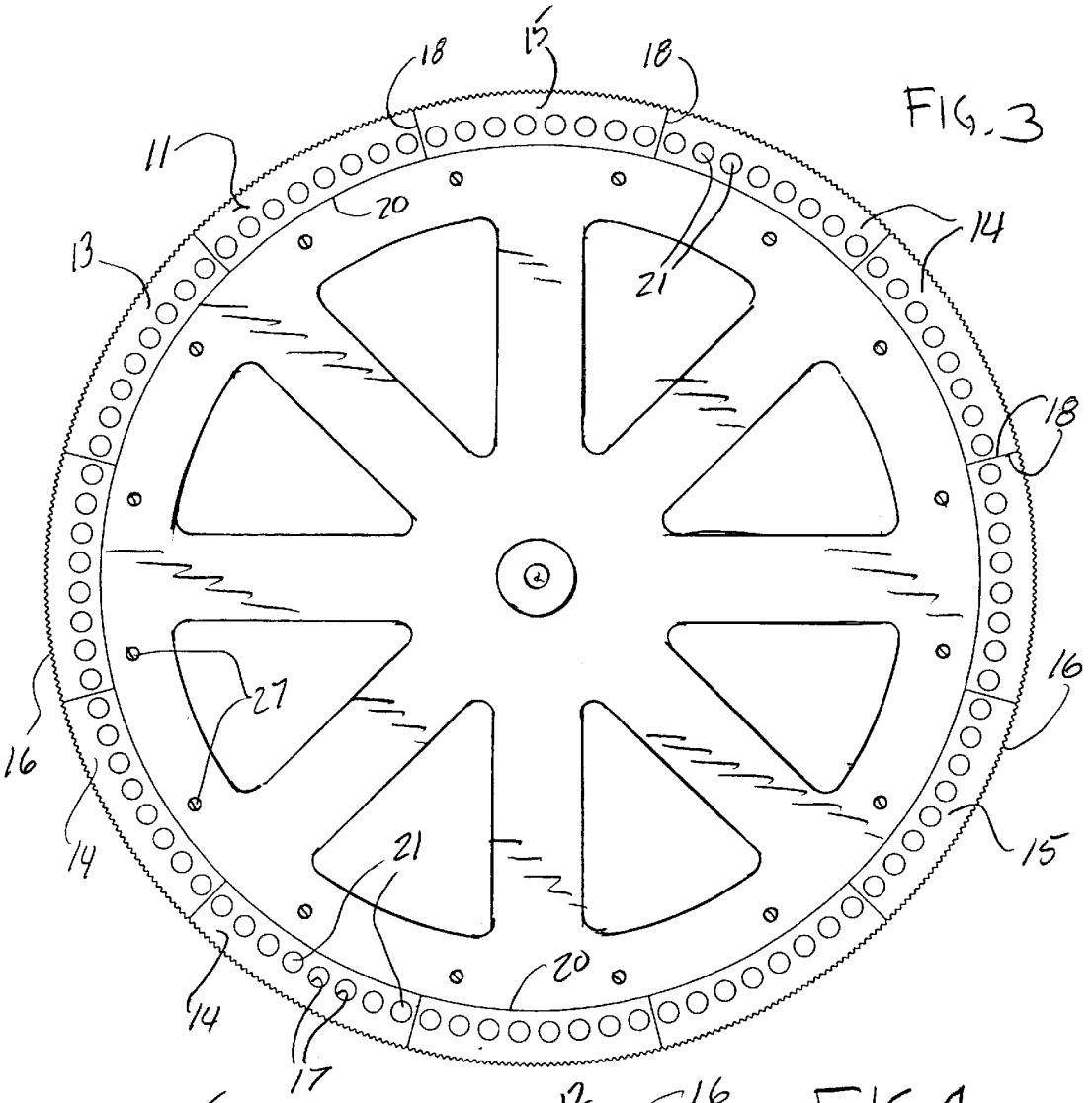
FIG. 3 is a vertical section taken on line 3—3 of FIG. 1.
Figure 4:
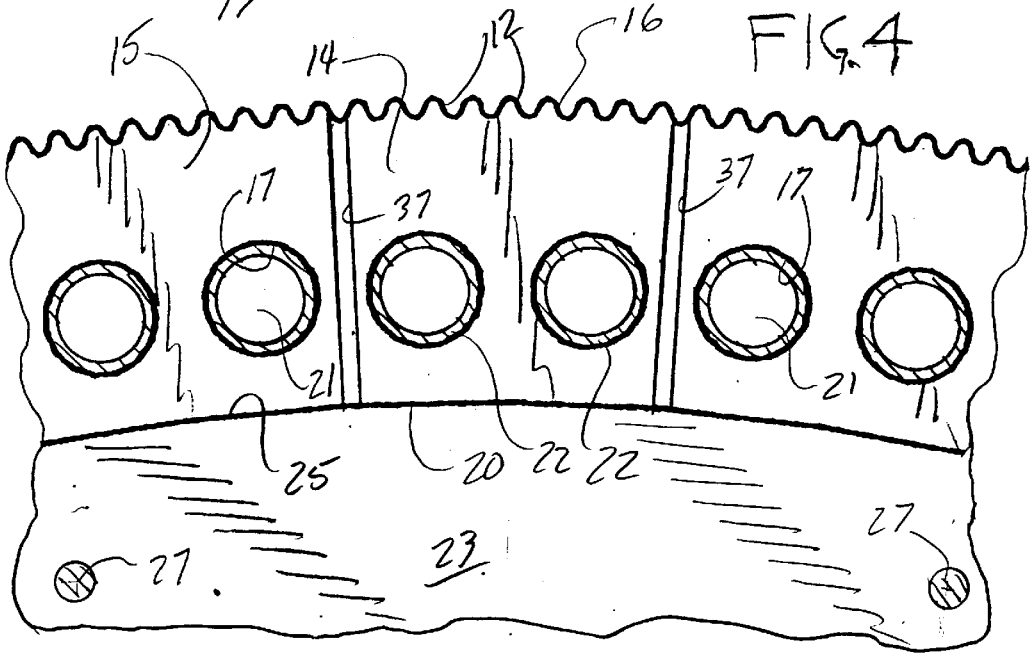
FIG. 4 is a vertical section taken on line 4—4 of FIG. 2.

Referring to FIGS. 2–4, the cylindrical outer wall 11 of the corrugating roll of the present invention is comprised of a laminated assembly of thin circular rings 13. The roll may have a diameter up to 48 inches (about 1200 mm) or larger. Each of the rings 13 is made up of a series of flat ring segments 14, each of which segments comprises an equiangular segment of the circular ring 13. The ring segments 14 are positioned end-to-end and suitably joined to form a complete circular ring 13. In the embodiment shown in the drawings, each ring segment 14 subtends an arc of 30°, thus requiring 12 segments to form a complete circular ring.

The ring segments 14 have parallel opposite faces 15 which define a segment thickness of, for example, ⅛ inch (about 3 mm). However, the thickness of the ring segments may be varied over a wide range. For circular rings having an outside diameter of 48 inches (about 1200 mm), the radial width of the segments is about 3 inches (76 mm).

The outer peripheral edge of each ring segment 14 is provided with a tooth pattern 16 sized and shaped to form the desired flute configuration in a corrugated paper web. It is important that the tooth pattern 16 be accurately formed and accurately positioned segment-to-segment such that when the segments are positioned end-to-end to form the circular ring 13, there is no discontinuity in the pattern.

The ring segments 14 are provided with a plurality of apertures 17 which extend between the opposite faces 15 of the segment. The apertures 17 are preferably equally spaced and positioned on a circular arc concentric with the arc of the ring segment. In the embodiment shown, each ring segment 14 includes eight apertures 17. However, the size and number of apertures in each ring segment may be varied as desired, the apertures in the embodiment shown having a diameter of 1 inch (25.4 mm) and spaced 1.5 inches (38.1 mm) on centers.

The ring segments 14 may be joined to form a circular ring 13 by welding adjacent segment edges 18. Similarly, the laminated array of circular rings 13 may be joined with welds, preferably along the circular inner edges 20 of the rings. However, other methods of assembling and joining the ring segments 14 and the circular rings 13 may also be utilized, either as a supplement to welded connections or in lieu thereof. The formed circular rings 13 are stacked to form the laminated cylindrical outer wall 11 in a manner to align the apertures 17 in the ring segments. The aligned apertures define a plurality of axially extending passages 21 through the cylindrical outer wall 11. As best seen in FIG. 3, the axial passages are equally spaced circumferentially around the entire cylindrical wall. A circular cross section tube 22 is inserted into each of the axial passages 21 and suitably joined to the passage wall. It is presently preferred to secure the tubes in position in the axial passages 21, and to simultaneously permanently join the laminated stack of circular rings 13, by explosive bonding or explosive welding. Utilizing known techniques, an explosive charge within the tube 22 is detonated, causing the tube to expand radially into intimate contact with the wall of the axial passage 21. An actual metallurgical bond or weld may be formed by this technique. In addition, or as a separate bonding technique, the tubes 22 may be secured in place with a high temperature solder.

In assembling the segmented circular rings 13 into the laminated cylindrical wall 11, and prior to insertion and attachment of the tubes 22, the ring segments 14 in adjacent rings may be rotationally offset such that the abutting edges 18 of the segments are staggered along the assembled cylindrical wall of the roll. In this manner, the ring segments may be secured in their circular ring configuration without welding or direct joining of contiguous segments in a ring. Permanent joining of the laminate of circular rings may still be accomplished in any of the ways already described or described hereinafter.

With reference to FIGS. 1–3, the corrugating roll 10 is completed by attaching a pair of end walls to the laminated cylindrical outer wall 11. The end walls may include a steam supply end wall 23 and a condensate return end wall 24. The end walls 23 and 24 are interconnected to support therebetween the cylindrical outer wall 11 generally in a manner described in detail in my co-pending application identified above. The steam supply end wall 23 is provided internally with a cylindrical annular shoulder 25 with a diameter matching the inside diameter of the circular rings 13 and with an axial length sufficient to support a number of ring widths. Similarly, the condensate return end wall 24 includes a cylindrical annular shoulder adapted to receive and support a number of laminations on the axially opposite end of the cylindrical outer wall 11. The end walls 23 and 24 may be welded to the cylindrical outer wall 11, as along the interface between the annular shoulders and the ID of the laminated circular rings. It is preferable, however, to interconnect the cylindrical end walls and to retain the laminated outer wall therebetween with a series of tie rods 27 extending the full axial length of the roll between the end walls. The axial interface between the cylindrical outer wall 11 and each of the end walls 23 and 24 may be sealed with pairs of concentric O-ring seals 36.

Also in a manner described in my prior co-pending application, identified above, the steam supply end wall 23 is provided with an annular slot 28 which functions as a supply header for steam to the ends of all of the tubes 22 distributed around the cylindrical outer wall of the roll. A steam supply line 30 may be utilized to deliver live steam axially through the center of the roll to the opposite steam supply end wall 23, from which it is transferred to the annular slot 28 via a series of radially extending steam distribution passages 31 formed in the end wall 23. From there, the steam travels along the steam tubes 22 to heat the cylindrical outer wall 11 to the desired processing temperature. The resulting condensate continues to travel along the steam tubes 22, under the influence of steam pressure, and is received in an annular header slot 32 in the condensate return end wall 24. The liquid condensate travels radially inwardly along condensate return passages 33 formed in the condensate return end wall 24. The condensate is withdrawn from the roll 10 via a condensate return line 34 utilizing a special control valve 35 described in my previously identified co-pending application.

Referring also to FIG. 4, it may be desirable to apply a vacuum to the flutes 12 in the cylindrical surface of the roll to help maintain the corrugated paperboard web in contact therewith and to enhance the transfer of heat from the roll to the paper web. Such vacuum systems are well known in the art, but in accordance with the laminated roll construction of the present invention, a suitable vacuum supply network may be readily provided. Each of the ring segments 14 is provided with a number of radial slots 37 running the full width of the segment from its inner edge to the root of a flute 12 on the outer edge thereof. In the assembled laminated outer wall 11, such a radial slot 37 may by itself provide a vacuum passage 38 so that a vacuum holddown force may be applied along the flute in communication with the passage 38. Alternately, an adjacent ring segment 14 may be provided with a similar radial slot 37 in the abutting face 15 such that the vacuum passage 38 comprises a double thickness slot, as shown in FIG. 2.

Figure 5:
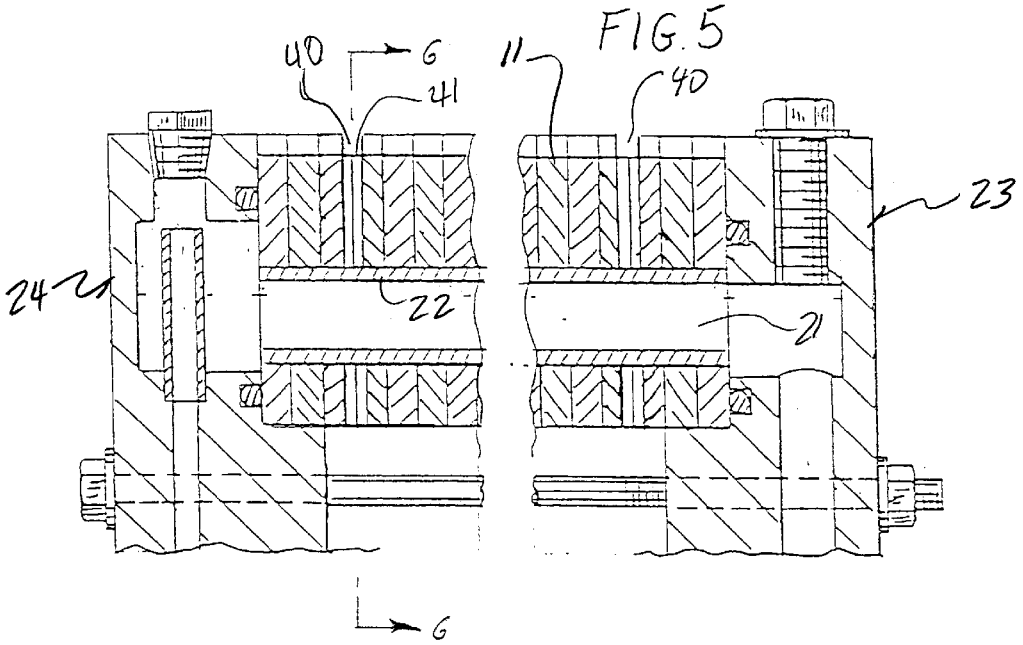
FIG. 5 is a view similar to FIG. 2 showing an alternate embodiment of the invention.
Figure 6:
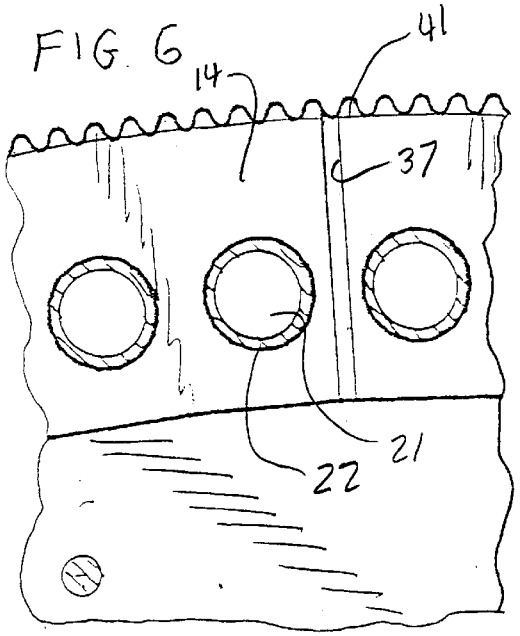
FIG. 6 is a sectional detail taken on line 6—6 of FIG. 5.
Figure 7:
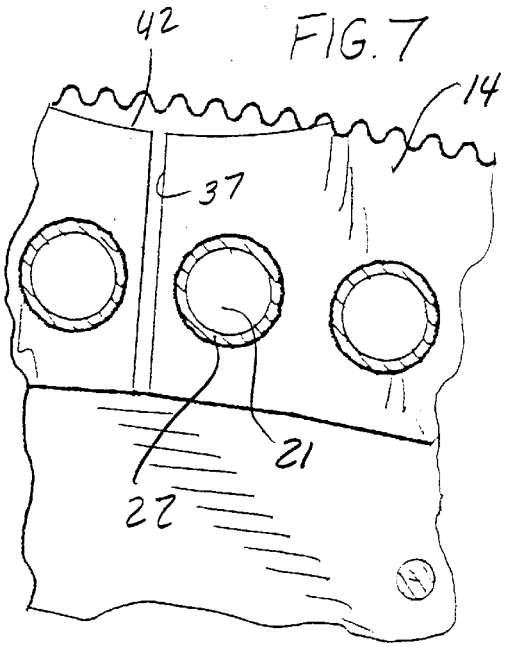
FIG. 7 is a sectional detail similar to FIG. 6 showing another embodiment.

Vacuum may be supplied to the radial inner ends of the passages 38 by any suitable prior art means (not shown). It may be desirable to distribute the vacuum holddown force to a larger number or to all of the flutes 12 in the roll surface. Referring to FIGS. 5–7, abutting faces 15 of adjacent ring segments 14 may be slotted along the toothed patterns 16 to provide annular or semi-annular vacuum distribution slots 40 so that the vacuum applied to a single vacuum passage 38 may be distributed to a number of flutes 12 in the roll surface. In one embodiment, the vacuum distribution slot may be provided by circular slots 41 running the full circumference of the roll and having a diameter approximately equal to the root diameter of the flutes 12 (FIG. 6). Alternately, a slot in the form of a circular arc 42 may be formed in abutting faces of ring segments 14 as shown in FIG. 7. In either case, the circular slots 41 or circular arc shaped slots 42 may be formed in the ring segments 14 at the time of initial segment fabrication. At the same time, the tooth patterns 16, apertures 17 and radial vacuum slots 37 are also conveniently formed in the segments 14 prior to roll assembly.

I claim:

1. A rotatable cylinder roll for carrying and treating a material web comprising:

a series of flat ring segments having opposite parallel faces, said segments positioned end-to-end and joined to form a circular ring;

each ring segment having a plurality of apertures extending between the opposite faces;

a plurality of said circular rings positioned face-to-face and joined to form said cylindrical roll;

the apertures aligned ring-to-ring to define a plurality of axially extending circumferentially spaced passages through the roll and, fluid conducting tubes inserted in said passages and joined to the passage walls defined by said apertures.

2. The cylindrical roll as set forth in claim 1 wherein said ring segments are joined by welds.

3. The cylindrical roll as set forth in claim 1 wherein said circular rings are joined by welds.

4. The cylindrical roll as set forth in claim 1 wherein said ring segments and said circular rings are joined by welds.

5. The cylindrical roll as set forth in claim 2 including roll enclosing end walls on opposite axial ends of said roll and tie rods interconnecting said end walls and joining said rings.

6. The cylindrical roll as set forth in claim 1 wherein said tubes are joined to said passage walls by explosive welds.

7. The cylindrical roll as set forth in claim 1 wherein said tubes are joined to said passage walls by soldered joints.

8. The cylindrical roll as set forth in claim 6 including a supplemental bonding agent in the interfaces between said passage walls and said tubes.

9. The cylindrical roll as set forth in claim 8 wherein said bonding agent comprises a solder.

10. The cylindrical roll as set forth in claim 1 wherein the ring segments in adjacent rings are rotationally offset.

11. The cylindrical roll as set forth in claim 10 including fluid conducting tubes inserted in said passages and joined to the passage walls defined by said apertures.

12. The cylindrical roll as set forth in claim 1 wherein said ring segments have patterns of flutes formed in the radial outer edges thereof, said flutes being aligned in the cylindrical roll to define a fluted roll surface.

13. The cylindrical roll as set forth in claim 1 including radially extending slots formed in the faces of selected ring segments, said slots defining in the assembled roll radial passages in communication with the outer surface thereof.

14. A cylindrical roll as set forth in claim 1, wherein said flat ring segments comprise:

radially extending opposite edges, each of said edges having a radially inner end and a radially outer end;

a generally semicircular outer edge extending between the radially outer ends of said opposite edges; and at least one of (1) a tooth pattern in said semicircular outer edge, (2) a plurality of apertures extending between said faces, (3) a radial slot in one of said faces, and (4) a peripheral slot in said semicircular outer edge.

15. The cylindrical roll set forth in claim 1 wherein said tubes are joined to said passage walls with metallurgical bonds.

* * * * *